US006836627B2

(12) United States Patent
Kretschmann et al.

(10) Patent No.: US 6,836,627 B2
(45) Date of Patent: Dec. 28, 2004

(54) MODE SWITCH AND ADJUSTABLE AVERAGING SCHEME FOR TANDEM TOP EDGE ELECTRONIC REGISTRATION

(75) Inventors: Deborah M. Kretschmann, Penfield, NY (US); Nicholas M. Lamendola, Lima, NY (US); Dean Thomas, Webster, NY (US); William D. Milillo, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/342,558

(22) Filed: Jan. 15, 2003

(65) Prior Publication Data

US 2004/0136733 A1 Jul. 15, 2004

(51) Int. Cl.[7] ..... G03G 15/00
(52) U.S. Cl. ..... 399/82; 399/394; 399/401
(58) Field of Search ..... 399/82, 394, 401, 399/81; 271/259, 270, 265.01, 265.02

(56) References Cited

U.S. PATENT DOCUMENTS 5,666,208 A 9/1997 Farrell et al.
5,725,211 A * 3/1998 Blanchard et al. ..... 271/265.02
5,930,577 A * 7/1999 Forsthoefel et al. ..... 399/401
5,994,711 A 11/1999 Seachman et al. ..... 250/559.36
6,271,535 B1 8/2001 Seachman et al.
6,373,042 B1 4/2002 Kretschmann et al. ... 250/208.1
6,511,239 B1 * 1/2003 Kretschmann et al. .. 399/394 X

OTHER PUBLICATIONS

European Search Report.

* cited by examiner

*Primary Examiner*—William J. Royer
(74) *Attorney, Agent, or Firm*—Fay, Sharpe, Fagan, Minnich & McKee LLP

(57) ABSTRACT

A printing apparatus places multiple images on a sheet 10, at least once on one side, and at least once on an opposite side. After the first printing, the sheet 10 is inverted by an inverter 50 and sent to a duplex path 42. Sensors 20, 40, both in a feed path 22 and the duplex path 42 detect the side edge of the sheet 10 to register the position of the sheet 10 to an image rendering device 14. A user has the option to input preferences at a user interface 26, the preferences including running average and registration options. More specifically, the user has the option to choose a number of sheets 10 used to calculate a running average for registration of both the simplexed and duplexed sheets 10. The user also has the option to select between image to image registration, and image to page registration for duplex printing.

16 Claims, 3 Drawing Sheets

MODE SWITCH AND ADJUSTABLE AVERAGING SCHEME FOR TANDEM TOP EDGE ELECTRONIC REGISTRATION

INCORPORATION BY REFERENCE

The present specification incorporates by reference U.S. Pat. Nos. 5,994,711 and 6,373,042 B1, assigned to the assignee hereof.

BACKGROUND

The present invention relates to the document duplication arts. It finds particular application in conjunction with dual sided photocopiers, and will be described with particular reference thereto. However, it is to be appreciated that the present invention is also amenable to other like applications.

Office equipment, such as printers and copiers, which place images based on digital data onto sheets, such as sheets of paper, are well known. More sophisticated types of office equipment are capable of placing images on both sides of a single sheet of paper, a feature often referred to as "duplexing." A typical configuration of a duplexing printer (the word "printer" including other types of equipment, such as digital copiers and facsimile machines) includes an image rendering device, meaning some hardware/software component that places a desired image on a sheet. Such a device is physically capable of printing only on one side of the sheet at a time. In order to print on both sides of the same sheet, it is necessary to feed a sheet through the image rendering device so the sheet can receive a first image on one side, and then invert the sheet and re-feed it back into the image rendering device so that the image rendering device can place a second image on the other side of the sheet. Although the specific architectures of various office equipment on the market vary widely, the path (along with any associated sheet-handling hardware, such as belts or rollers and motors) by which a sheet which has been output by the image rendering device is inverted and re-fed to the image rendering device can be generally referred to as a "duplex path."

In the market for office equipment having duplex features, a common customer requirement is a precise registration between an image printed on one side of the sheet with the image printed on the other side. If a single sheet having images on both sides thereof is held up to the light, it is desirable that the margins of the two images, particularly if the images include text, be perfectly superimposed. There is therefore a need to provide a system by which the image placed on one side of a sheet by the image rendering device is registered with the image on the other side of the sheet.

In other applications, it may be desirable to register the second side image to the page upon which it is printed, disregarding any image that may be printed on the first side. In an environment where the user may need to alternate between registering schemes, it is desirable to give the user control of how the images on the second side are registered.

Typically, in image registration, the image is not registered on a per page basis. That is, a registration processor does not receive a reading of a location of the instant page and adjust an image rendering device solely for that page. In some sophisticated devices, a running average of page position is taken and the instant page is typically registered based on that average. Depending on factors such as job length, acceptable misregistration, and others, different numbers of pages will be averaged for registration of subsequent pages. This can apply to both sides one and two. It is desirable to give the user control over the amount of pages used in the averaging scheme for registration depending on the job specifications.

The present invention contemplates a new and improved method and apparatus, which overcomes the above-referenced problems and others.

SUMMARY

In accordance with one aspect of the present invention, a document duplication apparatus is provided. The apparatus includes an image rendering device for affixing images to documents. First and second paths include first and second sensors, respectively. The sensors detect the position of the document. A controller controls positioning of the image rendering device based on information from the first and second sensors. A user interface allows a user to select between image-to-image and image-to-page registration.

In accordance with another aspect of the present invention, a document duplication apparatus is provided. The apparatus includes a feed path, the path having a sensor. An image placement controller registers an image rendering device based on a running average of positions of previous documents. A user interface allows a user to set a number of documents over which the running average is calculated.

In accordance with another aspect of the present invention, a method of image registration is provided. A document is fed along a feed path and an image rendering device is registered thereto with respect to an edge of the document. An image is affixed to the first side. The document is fed along a duplex path and the image rendering device is registered to the document again, with respect to a number of prior document positions. An image is affixed to the second side. A registration option for the second side image is selected, and a number of prior document positions from which to average is selected.

In accordance with another aspect of the present invention, a document duplication apparatus is provided. The apparatus includes feed and duplex paths, the duplex path having a sensor, the sensor detecting a position of the page. An image placement controller registers an image rendering device based on a running average of positions involving previous documents. A user interface allows a user to set the number of previous documents used for averaging and choose between registration relative to the side one image and registration to the page.

One advantage of the present invention resides in the ability to control a number of prints over which a running average is taken for side one and side two.

Another advantage of the present invention resides in the ability to control whether a side two image is registered with reference to a side one image or the page upon which it is printed.

Another advantage of the present advantage is the ability to make a tradeoff between system recovery and accuracy of image placement for both side one and side two.

Another advantage of the present invention resides in the ability to adjust print settings based on job parameters.

Still further advantages and benefits of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION

Figure 1:
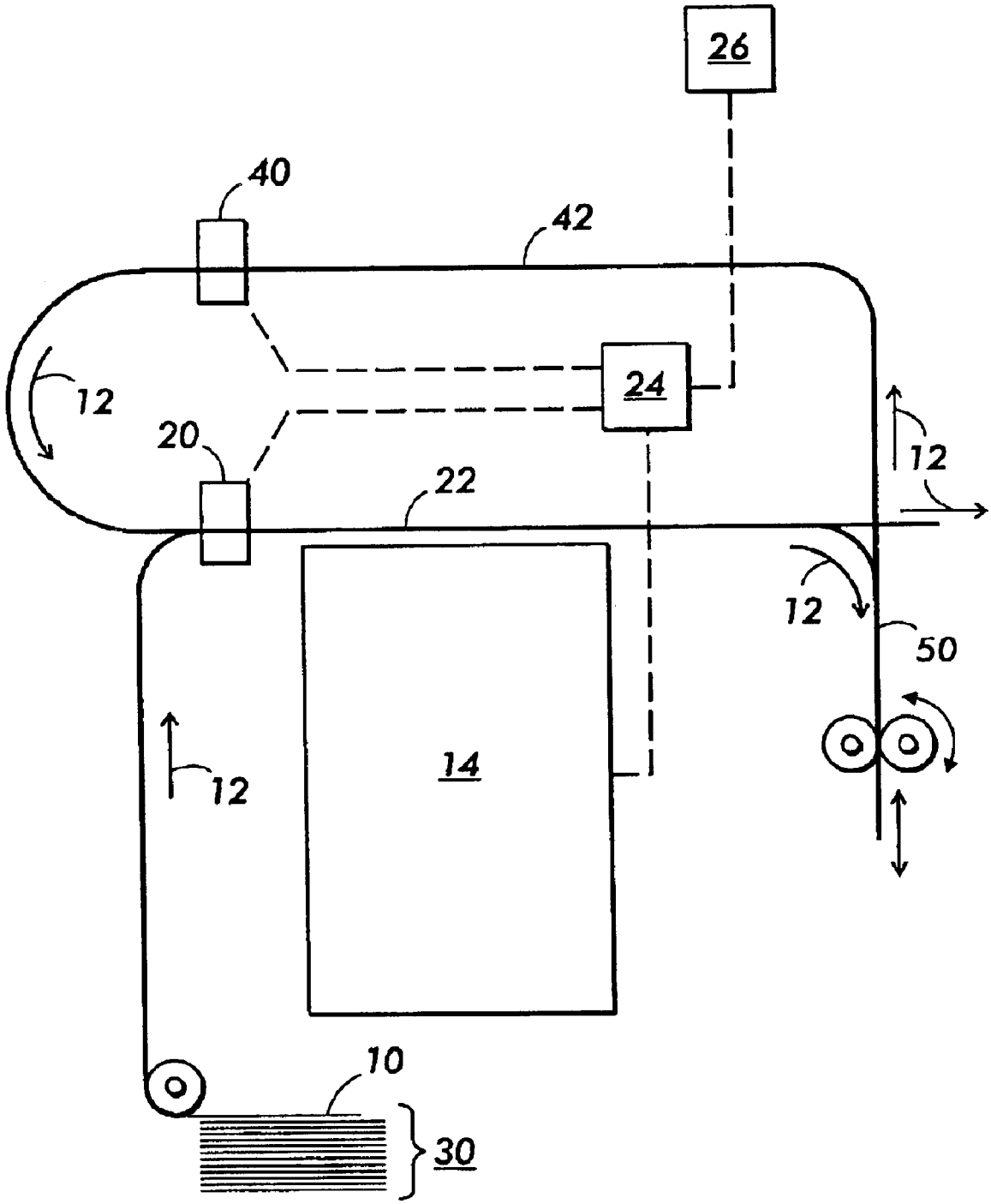
FIG. 1 is a diagrammatic illustration of a document duplication apparatus in accordance with the present invention.

With reference to FIG. 1, a sheet 10 is sent through a path in a process direction 12 toward an image rendering device 14. At a short interval before the sheet 10 is fed through the image rendering device 14 to receive an image thereon, the sheet 10 is caused to pass a sensor 20, which functions as an "edge position detector." More specifically to the preferred embodiment, the sensor 20 is a top edge position detector. There are many possible designs of the sensor 20 in the art which are capable of determining the position of the top edge of the sheet 10, such as optical sensors, mechanical sensors, and the like.

The sensor 20 determines the precise location of a "top edge" of the sheet 10 relative to a fixed point within the printer. As used in the specification herein, the top edge of the sheet 10, may be either edge of the sheet 10 which runs parallel to the process direction 12. For the sake of continuity, this is true even if the particular image placed on the sheet causes the "top edge" of the fed sheet 10 to be the side edge or bottom edge relative to the image printed thereon. The sensor 20 determines the precise distance of the top edge of the sheet 10 relative to some fixed point within the machine, and the determination of this distance is output by the sensor 20 as a "top edge position signal." In brief, the top edge position signal from the sensor 20 is symbolic of the measured position of the top edge of the sheet 10 being fed through a feed path 22 in the process direction 12.

The top edge position signal from the sensor 20 is then sent to a control system 24, which influences the operation of the image rendering device 14. The image rendering device 14 can be of any type known in the art, such as an electrophotographic "laser printer" device, or can alternately be an ink jet printer with a reciprocating printhead, or an ink jet printer with a page width printhead, or other xerographic device.

In a case in which the image rendering device 14 is an electrophotographic device, typically the image is placed on the sheet 10 by means of a narrow laser beam, which corresponds to a "fast scan direction." The fast scan direction is perpendicular to the process direction 12. The image rendering device 14 can respond to the edge position signal from the sensor 20 by coordinating a "start of scan" signal, indicating the precise time at which a leading edge of a raster line in an image to be printed starts to create an image.

In the case of an ink jet image rendering device with a relatively small printhead which reciprocates along the fast scan a direction, the signal from the sensor 20 can be used to determine the exact timing of the beginning of the printhead ejections with each printhead scan. This ensures a precise placement of the printed image relative to the edge of the sheet 10. In the case of an ink jet printer (or equivalent device, such as an ionographic head) which includes a printhead which extends the full width of a page, the edge position signal from the sensor 20 can be used to determine the exact subset of ejectors or ejector equivalents which are used to create the image on the sheet 10.

The description in FIG. 1 shows the basic case in which the sensor 20 determines the exact location of the edge of a sheet 10, and the information derived therefrom is used for precise placement of an image on the sheet 10. It is to be understood that variations on that basic concept are possible. For example, instead of determining the position of the edge and subsequently adjusting the image placement of an image on a single sheet 10, it may be more practical to place an image on a particular sheet 10 based on data about a plurality of previous sheets 10. For instance, it may be desirable to maintain a running average of the positions of previous sheets 10 which have been fed through the feed path 22, and use information from the previous sheets 10 for the placement of images on subsequent sheets 10. This general concept rests on the reasonable assumption that a sheet 10 running through the feed path 22 at a particular time will behave very similarly to a subsequent sheet 10 moving through the feed path 22.

In the preferred embodiment, a user interface 26 is included to provide a user control over how many sheets 10 are used to make the running average, in both the feed path 22 and a duplex path. An experienced user may wish to change this number based on the parameters of a certain job. For instance, in long copy jobs, it may be desirable to set the number relatively high, ensuring greater uniformity of the printed images over the whole job. In another example, the number may be set low for a short copy job, so not as many sheets 10 need to be discarded from the beginning of the job. Typically, if the number is set higher, the device is more resistant to small, temporary shifts in the paper position, but less responsive to permanent or semi-permanent deviations in the paper feeding process. Depending on the configuration of the system and the frequency of use of the duplex path, a separate input for the "running average" on the duplex path may be implemented.

Sheets 10 on which one or more images are desired to be printed are drawn from a sheet supply stack 30, of a design known in the art, and caused to move through the feed path 22. In addition to the sensor 20 in the feed path 22, there is a second sensor 40 in a duplex path 42. It is to be understood that the sensors 20, 40 can be located in other positions and are not limited to the illustrated positions as shown in FIG. 1. Sheets 10 traveling along the feed path 22 are initially sent through the image rendering device 14 to receive an image on at least one side thereof. Terms such as "feed path" and "duplex path" are intended to include not only the space defined for passage of sheets 10 therethrough, but also any necessary hardware to cause motion of the sheets 10 for the feed path 22 or duplex path 42, such as rollers, vacuum transports, belts, diverters, and the like. Even though the term "duplex path" is used for convenience, it will be understood that an equivalent of such a duplex path 42 will be apparent to a machine in which a sheet 10 is re-fed through an image rendering device 14 for any reason. Such a re-feeding may be to receive a second image thereon (even on the same side thereof).

Disposed along the duplex path 42, in the particular illustrated embodiment, is an inverter 50, as is generally known in the art. The function of the inverter 50 is to flip over a particular sheet 10, so that a second side of the sheet 10 can be re-fed to the image rendering device 14 for placing the second image thereon.

In accordance with the present invention, the sensor 20 acts as a page position detector for sheets 10 approaching the image rendering device 14 through the feed path 22, while the sensor 40 acts as an edge position detector for sheets 10 passing through the duplex path 42. Sheets 10 passing through duplex path 42 are typically those sheets 10 that have already been printed on one side thereof by image rendering device 14, and then inverted by the inverter 50, to be sent back to image rendering device 14 through the duplex path 42. Thus, in general, every sheet 10 passing through the duplex path 42 will already have an image on a first side thereof, and is approaching image rendering device 14 to receive a second image on the second, opposite side thereof.

According to the present invention, the control system or image placement controller 24 responds to signals from both sensors or optical detectors 20, 40, and uses this information to control the placement of images on sheets 10 by the image rendering device 14. In the preferred embodiment of the invention, two types of image placement control occur—feed path image placement control and duplex path image placement control. For sheets 10 traveling through the feed path 22, a running average of measurements of the location of the top edge for a set of sheets 10 is maintained. Such a running average may include an average of the last three sheets 10, or other selected number. This running average is used to control the placement of images on a subsequent sheet 10 at any particular time.

In the preferred embodiment, the user has the option of selecting between two types of image registration for the side two image—image to image registration or image to page registration. The user designates the selection at the user interface 26. Image to image registration minimizes show-through of a side one image to side two, and vice-versa. However, image to page registration may be desirable over image to image registration in some applications. Such an application may arise when areas are being filled in on a pre-printed sheet, where it is more important to localize a printed image with respect to the position of the page, rather than to an image on the other side.

In this regard, the user may choose to register the side two image from the position of the side one image, that is, an image to image registration. In image to image registration, the precise positions of sheets 10 passing through duplex path 42 are measured by the sensor 40 and reported to the image placement controller 24. Again, a running average (based on the user input to user interface 26) of the edge positions of previously-fed sheets 10 can be used for controlling the placement of images on subsequent sheets 10 passing through the duplex path 42.

Further, by comparing the running averages of the top edge positions of sheets 10 coming through the feed path 22 and the duplex path 42, a "shift factor" can be obtained. The shift factor is a mathematical relationship between the relative positions of sheets 10 coming through the feed path 22 and the duplex path 42. It is often found that the passage of a sheet 10 through the duplex path 42 results in a shift of the sheets 10 passing therethrough, and the shift is fairly consistent for all sheets 10 going through the duplex path 42 in a particular machine. By taking this consistent shift, as symbolized by the calculated shift factor, into account while the printer is running, the image placement controller 24 can control the image rendering device 14 to ensure registration of the first side image with the second side image on a single sheet.

Alternately, the user may choose to register the side two image from the position of the sheet 10, that is, an image to page registration. In image to page registration, the sensor or duplex path sensor 40 reports a position of the sheet 10 based on the top edge of the sheet 10, as with the sensor or feed path sensor 20. Indeed, when the same sheet 10 is duplexed using image to page registration, the process can be repeated using the location as determined from the sensor 40 in the duplex path 42. Another variation is to use a precise measurement of the top edge location of the sheet 10 being printed in combination with a derived shift factor, as with image to image registration, as determined by the difference in average locations in the feed path 22 and the duplex path 42.

Although the above-described system is one possible embodiment, other, more computationally sophisticated, techniques are contemplated. For instance, if the computing power available to the printing apparatus is fast enough, a system can be provided in which the precise location of a single sheet 10 is determined immediately before the sheet 10 is fed into the image rendering device 14. This is tantamount to n=1. The image rendering device 14 is then controlled to place an image with precision relative to the determined location of the top edge of that sheet 10.

Figure 2:
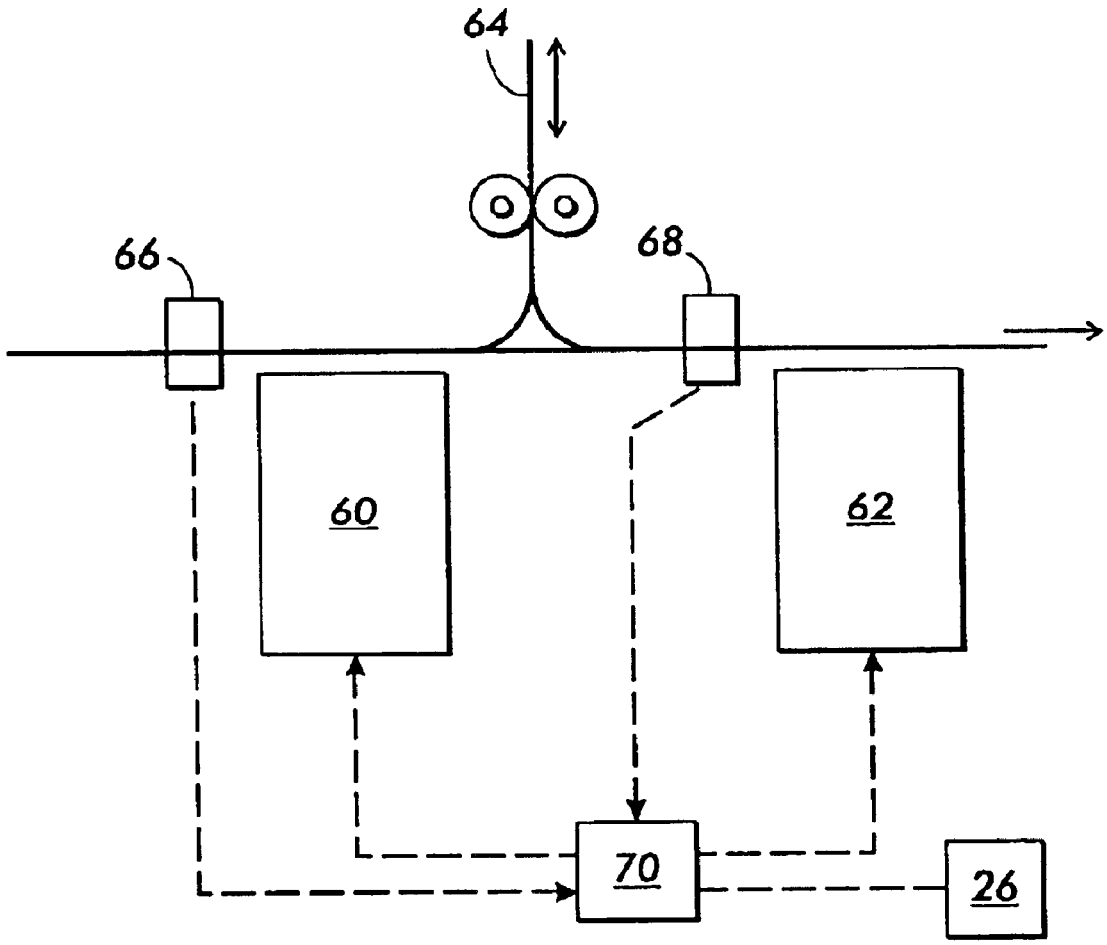
FIG. 2 is a diagrammatic illustration of document duplication apparatus including multiple image rendering devices, in accordance with the present invention; and, FIG. 3 is a flow diagram of one embodiment of the present invention including a registration decision step.

The various techniques of measurement and image position control shown in FIG. 1 are useful with a duplexing printing apparatus in which the same sheet 10 is passed twice through a single image rendering device 14. However, many of the same principles can be applied to a printing apparatus in which a sheet 10, even the same side of the sheet 10, is caused to pass through multiple image rendering devices, such as in a color printing apparatus. FIG. 2 is a simplified elevational view of a portion of a printing apparatus having two different image rendering devices, indicated as 60 and 62. In a practical embodiment, the image rendering device 60 could for example place black image rendering material on a sheet, while the image rendering device 62 places highlight color marking material, or magnetic MICR marking material on the sheet. The apparatus could further include an inverter 64, which would function largely as in the example of FIG. 1, that is, to make a second side of a sheet available to the image rendering device 62, for duplex prints.

In the printing apparatus shown in FIG. 2, sensors 66 and 68 provide signals relating to the precise location of the top edges of sheets passing therethrough, and send these signals to an image placement controller 70 (having connected thereto a user interface 26 such as that described in connection with FIG. 1), which in turn controls image placement of both image rendering devices 60 and 62. The same general principles as described above for operation of the image placement controller 24 in the duplex path 42 can similarly be applied to the apparatus of FIG. 2. For instance, the controller 70 can derive a shift factor describing a consistent shift of sheets passing between the two sensors 66 and 68. There may be different types of shift factors depending on whether the inverter 64 is being used or not, and the controller 70 can take this into account. Alternately, the controller 70 can detect, through the sensor 66, the precise location of the side edge of a sheet as it is entering the image rendering device 60. The controller 70 can use that information for precise placement of the image, and perform the same function with the sensor 68 and image rendering device 62.

The user controlled selections described herein activate discrete subroutines present in the software or provide values for variables within subroutines. Upon making a selection, the user activates a pointer that selects one of the subroutines or sets a value. The device includes default settings if no subroutines are selected or new data input. In an illustrative example, a user selects image to image registration for duplex copying, and a running average of six pages. The software places appropriate pointers to a subroutine(s) to accomplish image to image registration and a running average subroutine using n=6. During the job, the software ignores the other subroutines, such as image to page registration, and ignores other values for n, such as 3, 8, 10, or 12.

Figure 3:
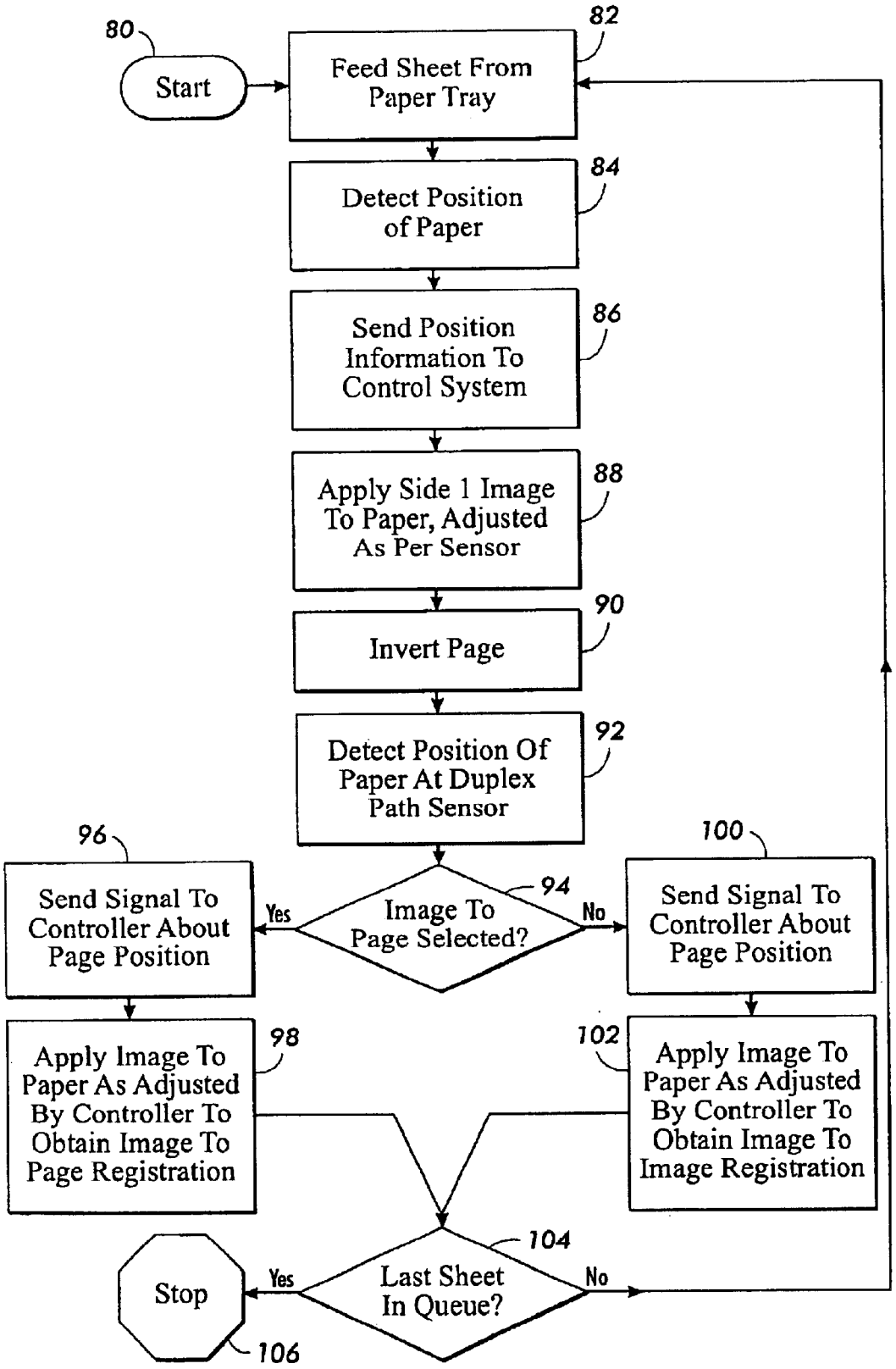

For example, with reference to FIG. 3, an embodiment of the method for user selection of registration techniques is illustrated in a flow diagram. A user starts a printing process 80. This causes a blank document to be fed from a paper supply tray 82. In a step 84, the position of the paper relative to fixed machine components is determined. In a step 86, the determined position information is sent to the control system. In step 88, a side one image is affixed to the paper, its position being adjusted by the control system as necessary to compensate for detected deviation. In an inversion step 90, the document is inverted and sent to a duplex path. In a step 92, a duplex path sensor detects the position of the document. As discussed previously, the position detection of the preferred embodiment is based on a running average of n previous sheets, the user having the option to manually select a value for n. In a decision step 94, the printing apparatus checks to see what image registration method has been selected, one of image to image registration and image to page registration.

If image to page registration is selected, the duplex path sensor sends a signal to the control system about the position of the page in a step 96. The image is affixed to the second side of the document 98, referenced relative to the document position. If image to image registration is selected, the duplex path sensor sends a signal to the control system about the position of the page in a step 100. The image is affixed to the second side of the document based on the position signal and a shift factor, as described above in a step 102, referenced to the image on the first side.

In a step 104, the system checks to see if the current document is the last document in queue. If yes, then the system stops 106. If the current document is not the last in queue, then the process is repeated.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications, variations, improvements, and substantial equivalents.

What is claimed is:

1. A document duplication apparatus comprising:

an image rendering device for affixing an image to a document;

a first path that includes a first sensor for detecting a first position of the document wherein the first sensor detects the first position of the document with respect to a position of an edge of the document;

a second path that includes a second sensor for detecting a second position of the document wherein the second sensor detects the second position of the document with respect to a position of an edge of the document;

a controller associated with the image rendering device that controls the image rendering device to place a second image in accordance with one of:

position data from the first sensor and the second sensor; and, position data from the second sensor;

a user interface through which a user selects whether the controller controls the image rendering device based on position data from the second sensor, or position data from the first and second sensors.

2. The document duplication apparatus as set forth in claim 1, wherein the controller calculates a running average over a number of documents and registers the image rendering device with respect to the running average.

3. The document duplication apparatus as set forth in claim 2, further including:

a second user interface through which the user selects a number of documents over which the running average is calculated.

4. The document duplication apparatus as set forth in claim 1, wherein the first sensor senses the document position with respect to a top edge of the document.

5. The document duplication apparatus as set forth in claim 1, wherein:

the controller uses data from both the first path sensor and the second sensor to perform an image to image duplex registration; and, the controller uses data from the second path sensor only to perform an image to page duplex registration.

6. A document duplication apparatus comprising:

a feed path;

a duplex path;

a duplex path sensor that senses a position of a document after a first image has been affixed to a first side of the document;

an image placement controller that registers an image rendering device based on a running average of positions involving a number of previous documents; and, a user interface that allows a user to set the number of previous documents.

7. The document duplication apparatus as set forth in claim 6, wherein the image placement controller registers the image rendering device with respect to an average of positions of the previous documents.

8. The document duplication apparatus as set forth in claim 6, wherein the user interface allows the user to select one of second image registration with respect to document position and second image registration with respect to the first image on the first side of the document.

9. The document duplication apparatus as set forth in claim 6, further including:

a feed path registration sensor that senses a position of the document with respect to at least one of the edges of the document.

10. A method of image registration comprising:

feeding a document along a feed path;

registering an image rendering device with respect to an edge of the document;

affixing an image to a first side of the document;

inverting the document;

feeding the document along a duplex path;

registering the image rendering device with respect to a number of prior document positions;

affixing an image to a second side of the document;

selecting between first and second duplex registration options, wherein a first option registers the image rendering device with respect to the document position while rendering the image on the second side, and wherein a second option registers the image rendering device with respect to the image on the first side while rendering the image on the second side; and, selecting the number of prior document positions from which to register the image rendering device.

11. The method as set forth in claim 10, wherein the step of registering the image rendering device with respect to an edge of the document registers the image rendering device with respect to a side edge of the document.

12. The method as set forth in claim 10, wherein the step of registering the image rendering device with respect to a number of prior document positions includes:

recording and averaging positions of prior documents; and, applying the most recent average to the current document.

13. The method as set forth in claim 10, wherein the step of affixing an image to the second side includes:

affixing an image to the second side that is aligned with the image on the first side using position information from both a feed path position sensor and a duplex path position sensor.

14. The method as set forth in claim 10, wherein the step of affixing an image to the second side includes:

affixing an image that is aligned with respect to the position of the document using position information from a duplex path position sensor only.

15. A document duplication apparatus comprising:

a feed path;

a duplex path;

a duplex path sensor that senses a position of a document after a first image has been affixed to a first side of the document;

an image placement controller that registers an image rendering device based on a running average of positions involving a number of previous documents, the registration being relative to one of the first image and the position of the document;

a user interface that allows a user to set the number of previous documents and allows the user to choose between registration relative to the first image and registration relative to the document position.

16. The document duplication apparatus as set forth in claim 15, wherein the image placement controller uses position information from the duplex path sensor to perform a duplex image to page registration, and uses position information from the duplex path sensor and a feed path sensor to perform a duplex image to image registration.

* * * * *